United States Patent [19]

Uytterhoeven et al.

[11] Patent Number: 4,525,446

[45] Date of Patent: Jun. 25, 1985

[54] LIQUID DEVELOPER FOR DEVELOPMENT OF ELECTROSTATIC IMAGES COMPRISING ONIUM SALT POLYMER AND AN ANION

[75] Inventors: Herman J. Uytterhoeven, Bonheiden; Yvan K. Gilliams, Hever; Walter F. De Winter, 's-Gravenwezel; August M. Mariën, Oevel; Noël J. De Volder, Edegem, all of Belgium

[73] Assignee: Agfa-Gevaert, N.V., Mortsel, Belgium

[21] Appl. No.: 563,561

[22] Filed: Dec. 20, 1983

[30] Foreign Application Priority Data

Jan. 20, 1983 [EP] European Pat. Off. ..... 83200085.5

[51] Int. Cl.[3] ..... G03G 9/08; G03G 9/12

[52] U.S. Cl. ..... 430/117; 430/115; 430/119

[58] Field of Search ..... 430/115, 117, 119

[56] References Cited

U.S. PATENT DOCUMENTS

| | | | |
|---|---|---|---|
| 3,926,825 | 12/1975 | Honjo et al. | 430/115 |
| 3,977,983 | 8/1976 | Tsuneda | 430/115 |
| 4,161,453 | 7/1979 | Gilliams et al. | 430/115 |
| 4,202,785 | 5/1980 | Merrill et al. | 430/117 X |
| 4,229,513 | 10/1980 | Merrill et al. | 430/115 |

*Primary Examiner*—John E. Kittle
*Assistant Examiner*—Mukund J. Shah
*Attorney, Agent, or Firm*—A. W. Breiner

[57] ABSTRACT

A liquid developer composition for rendering visible electrostatically charged areas. The composition contains in an electrically insulating non-polar carrier liquid having a volume resistivity of at least $10^9$ ohm.cm and a dielectric constant less than 3, dispersed coloring matter acting as toner particles and at least one onium salt polymer including recurring units incorporating an onium group together with an anion. The anion has at least one of the following characteristics:

(1) contains a negatively charged atom or group of atoms which is sterically embraced by at least two non-ionic substituents containing at least 4 C atoms;

(2) contains a negatively charged atom which is sterically embraced by at least 4 atoms selected from the group consisting of oxygen and halogen;

(3) contains a negatively charged atom or group of atoms the negative charge of which is delocalized over other atoms linked to said atom or group of atoms;

(4) is a radical anion, whereby the onium salt polymer is adsorbed with a net positive charge on the toner particles. An illustrative onium salt polymer species is a copolymer of isobutyl methacrylate, stearyl methacrylate and dimethylaminoethyl methacrylate that has been quaternized with methyl iodide and of which the iodide anions have been replaced by tetraphenyl boride anions.

13 Claims, No Drawings

LIQUID DEVELOPER FOR DEVELOPMENT OF ELECTROSTATIC IMAGES COMPRISING ONIUM SALT POLYMER AND AN ANION

The present invention relates to a liquid developer for development of electrostatic images.

Known electrophotographic processes comprise the steps of electrostatically charging in the dark a photoconductive surface, image-wise exposing said surface whereby the irradiated areas become discharged in accordance with the intensity of radiation thus forming a latent electrostatic image, and developing the material to form a visible image by depositing on the image a finely divided electroscopic material known as "toner". The toner particles consist of or include colouring substances e.g. carbon black. The thus developed image may be fixed to the surface carrying the electrostatic charge image or transferred to another surface and fixed thereon.

A process of developing an electrostatic image by use of an electrically insulating liquid developer, which contains dispersed particles of colouring substance called toner particles, that render the charge pattern visible through the phenomenon of electrophoresis, has been described already e.g. in the U.S. Pat. No. 2,907,674 of Kenneth Archibald Metcalfe and Robert John Wright issued Oct. 6, 1959.

In electrophoretic development a distinction is made between developers having dispersed toner particles which possess a positive charge and those which possess a negative charge. The charge value and the polarity of the toner particles are influenced by means of one or more so-called charge control agents.

In order to fix the toner particles at the places where they are deposited electrostatically, each particle comprises a thermoplastic resin coating, which may also play the role of dispersing agent and may serve also as charge control agent when containing ionic groups.

Charging of the dispersed particles may proceed according to one method by a chemical compound that provides a charge from a chemical dissociation reaction on the toner particle surface and the introduction of a counter-ion in the electrically insulating carrier liquid.

According to U.S. Pat. No. 3,977,983 a liquid for use in the development of an electrostatic charge pattern is provided, said liquid developer containing as charge-controlling agent a copolymer having amino groups converted into quaternary ammonium salt groups or quaternary ammonium hydroxide, the anions of said copolymer rendering the toner particles negatively charged.

These particular copolymers are described as being well-soluble in the carrier liquid and imparting a sufficient charge to the toner particles without lowering the electric resistance of the carrier liquid when dissolved therein.

According to the U.S. Pat. No. 4,273,849 stable negatively charged liquid developers can be formed with halogenated polymers by dispersing them in a carrier liquid in admixture with certain soluble copolymeric quaternary ammonium salts which serve as dispersing agents and with certain soluble polar addition copolymers which serve as stabilizers. The copolymeric quaternary ammonium salt is a copolymer of a quaternary ammonium salt monomer and a solubilizing monomer, said copolymer being free of cations of alkali metals and alkaline earth metals. The polar addition copolymer serving as stabilizer is a soluble copolymer of an acrylic polar monomer and a solubilizing monomer, the amounts of solubilizing monomer units in each copolymer being sufficient to make the copolymer soluble in the carrier liquid. Counter-anions mentioned in the above U.S. patent prior art are e.g. chloride, bromide, iodide, methyl sulphate, ethyl sulphate, p-toluene sulphonate and the hydroxyl anion.

It is an object of the present invention to provide an electrophoretic liquid developer containing positively charged toner particles with stable particle charge, i.e. a particle charge that is practically invariable with time.

Other objects and advantages of the present invention will be clear from the further description.

According to the present invention a liquid developer composition is provided that is suitable for rendering visible electrostatically charged areas, which composition contains in an electrically insulating non-polar carrier liquid having a volume resistivity of at least $10^9$ ohm.cm and a dielectric constant less than 3, dispersed colouring matter acting as toner particles and at least one polymer, called onium salt polymer including units incorporating an onium group together with a counter anion, characterized in that the said anion has at least one of the characteristics (1) to (4):

(1) contains a negatively charged atom or group of atoms which is sterically embraced by at least two non-ionic substituents containing at least 4 C atoms;

(2) contains a negatively charged atom which is sterically embraced by at least 4 atoms selected from the group consisting of oxygen and halogen;

(3) contains a negatively charged atom or group of atoms the negative charge of which is delocalized over other atoms linked to said atom or group of atoms;

(4) is a radical anion, whereby the said polymer is adsorbed with a net positive charge on the toner particles.

The use of anions having a large effective radius according to (1) to (4), ensures that the negative charge of the anion does not stem from one or more electrons forming a point charge at its surface. The charge density is lowered by enlarging the anion radius so that only a weak electric field strength is present at the periphery of the anion whereby the dissociation of the ion pair composed of the onium group and its counter anion increases and whereby the adsorption power of the anion to polar surfaces present in toner particles, is reduced. A lessened adsorption tendency of the anions makes possible a stronger adsorption of the cationic onium groups to the toner particle surface so that it is directly surrounded by positively charged polymer.

Anions of the following groups I, II, III, IV, V and VI for use according to the present invention have a large radius and a correspondingly low surface charge density ($C/m^2$).

Group I

Polyatomic anions wherein the negative charge is localized on an atom or atomic group which is sterically embraced or surrounded by at least two non-ionic hydrocarbon substituents each containing at least 4 carbon atoms.

Examples of such anions are: sterically hindered phenolates and aromatic carboxylates e.g. benzoates having as substituents $C_4$–$C_{20}$ alkyl, aralkyl cycloalkyl or aryl groups, preferably in ortho-position to embrace the $—O^-$ or $—COO^-$ group; tetrahydrocarbon substituted boride anions according to the following general formula:

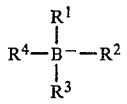

wherein:

each of $R^1$, $R^2$, $R^3$ and $R^4$ (same or different) represents a $C_4$–$C_{20}$ alkyl, alkenyl, cycloalkyl, aralkyl e.g. benzyl or aryl group, e.g. a phenyl or a tolyl group.

The tetraphenylboride anion in alkali metal salts has been described e.g. in The Journal of Physical Chemistry, Vol. 69, No. 2, February 1965 pp. 608–611.

Group II

Polyatomic anions which contain a negatively charged central atom embraced by at least 4 oxygen atoms e.g. $ClO_4^-$ and $ReO_4^-$.

Polyatomic anions containing a negatively charged central borine, arsenic, aluminium, silicon, phosphorus, tin, antimony, tantalum or bismuth atom surrounded by at least 4 halogen atoms, e.g. fluorine atoms.

Examples of the last mentioned anions are: ($PF_6^-$), ($AsF_6^-$) and ($TaF_6^-$).

($PF_6^-$) and ($TaF_6^-$) anions are described in Scientific American, July 1982 p. 59 as negatively charged ions in organic superconducting crystals.

Group (III)

Polyatomic anions wherein the negative charge is delocalized over an aromatic conjugated system of alternating single and double bonds by the presence thereon of one or more electron-withdrawing (electronegative) substituents.

Examples of such anions correspond to the following general formula:

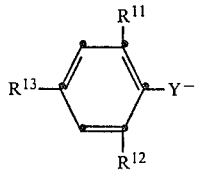

wherein:

$Y^-$ represents a $—O^-$ or $—S^-$ group, and $R^{11}$, $R^{12}$ and $R^{13}$ (same or different) is an electron-withdrawing substituent i.e. $—NO_2$, halogen, —CN, $—CF_3$, —CHO and the like.

A survey of "electron-withdrawing substituents" has been given by Peter Sykes in "A Guidebook to Mechanism in Organic Chemistry"—Longmans, London—5th impression (1963) p. 107. At p. 18 of said book the following is mentioned: "the nitro group lowers the density of negative charge over the nucleus, as compared with benzene itself; it is an electron-withdrawing group in contrast to the negatively charged oxygen atom in the phenoxide ion, which is an electron-donating group".

Group IV

Anions of cyanocarbon acids.

These acids (ref. W. J. Middleton and co-workers, J. Am. Chem. Soc. 80, 2795 (1962) are organic molecules that contain a plurality of cyano groups and are readily ionized to hydrogen ions and resonance-stabilized anions i.e. anions with delocalized negative charge. Examples of the acids are given by Kirk-Othmer "Encyclopedia of Chemical Technology" 3th ed. Vol. 7 (1979)—John Wiley & Sons, New York p. 364, e.g. cyanoform or methane-tricarbonitrile and 1,1,2,3,3-pentacyanopropene.

Group V

Anions of anionic dyes, having in the anion part a delocalized negative charge. Such dyes are e.g.:

phthalocyanine dyes, e.g.:

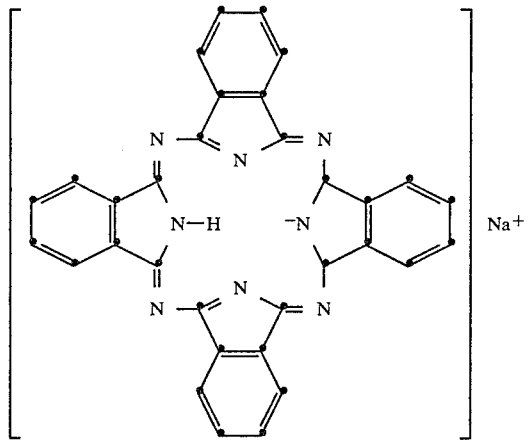

oxonol dyes, i.e. acid dyes linking two ketomethylene nuclei by a methine group or a methine chain e.g.:

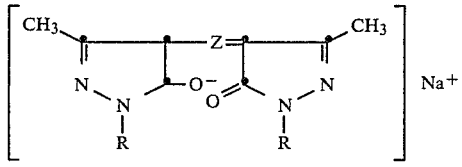

wherein:

Z is a methine group or a methine chain, and

R is an aryl group e.g. phenyl.

phenolphthaleine dyes, e.g.:

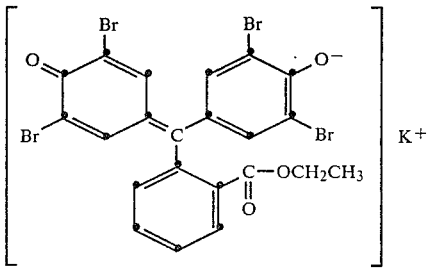

(potassium tetrabromophenolphthaleine ethyl ester)

Group VI

Radical anions contain an unpaired electron and a negative charge on different atoms. For a monograph relating to this type of ions see Kaiser and Kevan "Radical Ions"—Interscience Publishers, New York 1968.

Radical anions for use according to the invention are:

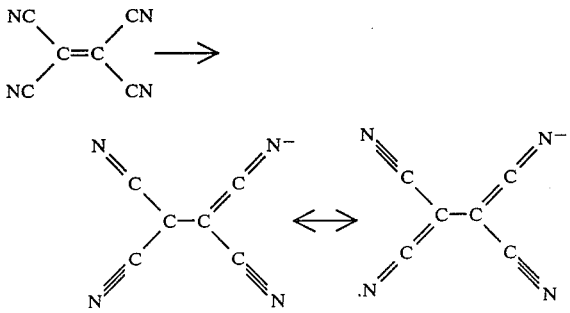

tetracyanoethylene=TCNE

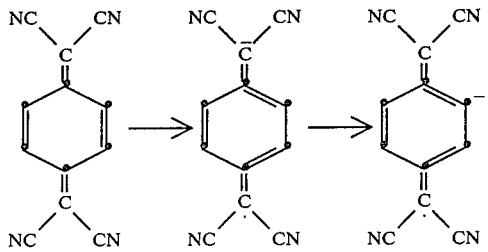

7,7,8,8-tetracyano-p-quinodimethane=TCNQ

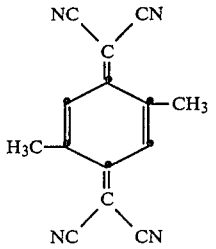

2,5-dimethyl-7,7,8,8-tetracyano-p-quinodimethane = DMTCNQ 2,5-dimethyl-7,7,8,8-tetracyano-p-quinodimethane=DMTCNQ Stable ion radicals other than TCNQ anion radicals are easily prepared from aromatic hydrocarbons, e.g. 9,10-diphenylanthracene, by electrochemical reduction in acetonitrile or dimethylformamide-containing electrolytes such as tetrabutylammonium perchlorate (ref. Kirk-Othmer in the already mentioned "Encyclopedia of Chemical Technology" Vol. 5 (1979) p. 430.

The preparation of polymers containing TCNQ as counter anion for polymeric cations is described e.g. in Journal of Polymer Science, Polymer Chemistry Edition, Vol. 16, 3261–62 (1978), and in Journal of Polymer Science: Part C No. 16 p. 1568–73 (1967).

The onium salt polymers used in the invention may be homopolymers or copolymers.

The onium group in the polymers used according to the present invention may be e.g. an ammonium, phosphonium or sulphonium group. The onium salt polymers for use according to the present invention may be prepared by addition polymerisation of the corresponding monomer in salt form or with the monomer in non-salt form e.g. as amine which is quaternized later on.

An other way of preparing polymers with onium groups is to start with haloalkyl-containing polymers e.g. a copolymer containing benzylene chloride groups, which groups react as alkylating agent with e.g. amines, phosphines or sulphides e.g. thioethers.

When preparing a copolymer containing onium salt recurring units, these monomer units may be distributed at random in the copolymer chain preferably together with solvatizing monomer units. The copolymer may likewise be a block- or graft copolymer containing groups or blocks of said monomer units. The salt production or quaternization has not to proceed quantitatively, which means that residual haloalkyl-, amine-, sulphide-, or phosphine groups may still be present.

Suitable onium salt monomers are exemplified hereinafter in List I by general formulae (A), (B), (C), (D), (E), (F) and (G).

List I

Suitable onium salt monomers correspond to one of the following general formulae:

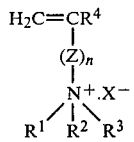

(A)

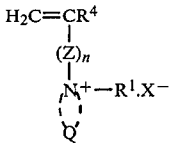

(B)

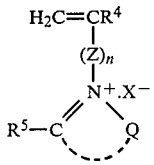

(C)

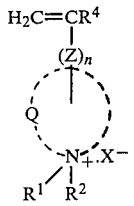

(D)

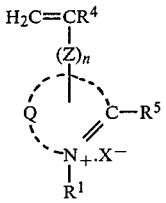

(E)

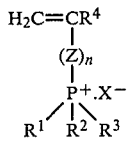

(F)

-continued

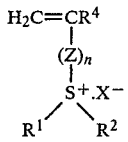

(G)

wherein:

each of $R^1$, $R^2$ and $R^3$ (same or different) represents hydrogen, an alkyl, a cycloalkyl, an aralkyl e.g. benzyl or an aryl group e.g. phenyl, each of $R^4$ and $R^5$ is hydrogen or $C_1$–$C_4$ alkyl, Q represents the atoms necessary to complete a 5- or 6-membered heterocyclic ring, Z is selected from the group consisting of $—R^6—$, $$—\overset{O}{\overset{\|}{C}}—OR^6—,\ —\overset{O}{\overset{\|}{C}}—NH—R^6—,\ —O—\overset{O}{\overset{\|}{C}}—R^6—,\ \text{and}$$

$$—CH_2—O—\overset{O}{\overset{\|}{C}}—R^6$$

wherein:

$R^6$ is alkylene, arylene, or arylenealkylene (e.g. benzylene) having from 1 to 20 carbon atoms, n is 0 or 1, and $X^-$ is an anion as characterized hereinbefore.

Particularly good results are obtained with $X^-$ being:

tetraphenyl boride

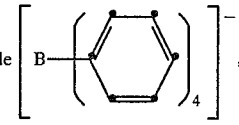

tetradiphenyl boride

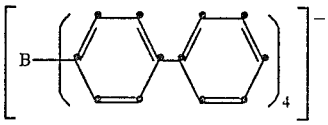

and 2,6-di-t-butyl-4-nitrophenolate

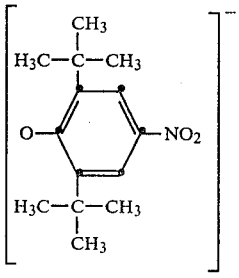

Preferably for obtaining a better dispersing character copolymers are used which contain said onium salt monomers in conjunction with non-ionic hydrophobic solvatable monomers.

Optionally used non-ionic hydrophobic solvatable monomers are listed hereinafter in List II.

List II alkylstyrenes having from 3 to 10 carbon atoms in the alkyl group, alkoxystyrenes having from 3 to 10 carbon atoms in the alkyl group, alkyl acrylates and methacrylates having from 8 to 22 carbon atoms in the alkyl group, vinyl alkyl ethers having from 8 to 22 carbon atoms in the alkyl group, vinyl esters of alkanoic acids having from 6 to 22 carbon atoms in the alkyl group.

Preferred non-ionic hydrophobic solvatable monomers are: lauryl acrylate, lauryl methacrylate, hexadecyl methacrylate, octadecyl methacrylate, vinyl laurate, vinyl palmitate, vinyl stearate, vinyl eicosate and vinyl docosate.

The non-ionic hydrophobic solvatable monomer units may be used in admixture with substantially non-solvatable non-ionic monomer units. Examples of such non-ionic non-solvatizing monomers are enumerated in List III.

List III (a) $\alpha,\beta$-ethylenically unsaturated carboxylic acid alkyl esters with alkyl $C_1$–$C_4$ group.

(b) styrene, methylstyrene, methoxystyrene and halogenated styrene;

(c) vinyl alkyl ethers having from 1 to about 4 carbon atoms in the alkyl group, and (d) vinyl esters of alkanoic acids having from about 1 to about 4 carbon atoms in the alkyl groups and mixtures thereof.

Examples of non-ionic "non-solvatizing" monomers are: styrene, vinyltoluene, ethyl acrylate, propyl methacrylate, isobutyl methacrylate, vinyl acetate, vinyl propionate, vinyl butyrate and mixtures thereof. These monomers make the resulting copolymer harder so that smearing out of the deposited toner image is much more difficult.

In order to illustrate in detail the preparation of polymers containing onium salt monomers the following preparations are given.

Preparation I

A. Copolymerization of isobutyl methacrylate, stearyl methacrylate and dimethylaminoethyl methacrylate (copolymer A).

A solution of:

70 g of isobutyl methacrylate, 20 g of stearyl methacrylate, 10 g of dimethylaminoethyl methacrylate and 0.2 g of azo-diisobutyronitrile in 400 ml of butanone was heated at 70° C. whilst stirring after bubbling-through nitrogen gas to expel oxygen of the air. The copolymerisation was continued at 70° C. for 20 h. After cooling to 20° C. the polymer solution was precipitated in cool methanol. The sticky polymer precipitate was dried under reduced pressure and pulverized. The amino-monomer content determined by analysis of the nitrogen content was 13.45% by weight.

B. Quaternizing of copolymer A with methyl iodide (copolymer B).

To a solution of 20 g of copolymer A 5 g of methyl iodide in 100 ml of acetone was added and the reaction mixture was heated at 40° C. whilst stirring for 20 h. The solvent was evaporated under reduced pressure conditions and the residue dried under the same conditions. The iodide ion content was determined by titration and corresponded with 15.82% by weight of onium salt units in the copolymer.

C. Quaternizing copolymer A with n-hexadecyl-sulphonic acid methyl ester (copolymer C).

To a solution of 50 g of copolymer A 13.7 g of n-hexadecylsulphonic acid methyl ester in 200 ml of butanone was added and the reaction mixture was refluxed for 20 h. After cooling the quaternized copolymer was separated by precipitation in water and dried under reduced pressure.

D. Substitution of the iodide anions in copolymer B with tetraphenyl boride anions (copolymer D).

To a solution of 20 g of copolymer B in 150 ml of methanol a solution of 3.625 g of tetraphenyl boride sodium salt in 25 ml of methanol was added dropwise in 25 ml of methanol. Immediately a sticky precipitate was formed. After several hours of stirring at 20° C. the supernatant liquid was poured off and the sticky copolymer was vacuum-dried and pulverized. By analysis the absence of iodide was confirmed which was a proof for a complete transformation into the onium boride salt.

E. Substitution of the iodide anions in copolymer B with 2,4,6-t-butylphenolate anions (copolymer E).

To a solution of 20 g of copolymer B in 150 ml of methanol 3.01 g of 2,4,6-t-butyl phenolate sodium salt in 100 ml of methanol was added. The colour of the solution turned from light yellow to light blue and thereupon faded to colourless and finally became light brown. The reaction mass was stirred at room temperature for 24 h. The copolymer was separated by precipitation in water and was vacuum-dried.

By determination of the residual iodide content it was found that 70% of the onium salt units was transformed into onium salt units with 2,4,6-t-butylphenolate counter-anion.

Preparation II

F. Copolymerization of isobutyl methacrylate, stearyl methacrylate and 4-vinylbenzyl chloride (copolymer F).

A solution of:

60 g of isobutyl methacrylate 20 g of stearyl methacrylate 20 g of 4-vinylbenzyl chloride and 0.3 g of benzoyl peroxide in 200 ml of butanone was heated at 80° C. whilst stirring after expelling oxygen of the air by bubbling through nitrogen gas. The copolymerization was continued whilst stirring at 80° C. for 20 h.

After cooling the copolymer was precipitated in methanol. The slightly sticky copolymer was vacuum-dried and pulverized. By determination of the chlorine content the content of 4-vinylbenzyl chloride units was found to be 20% by weight of the copolymer.

G. Quaternizing of copolymer F with triethylamine (copolymer G).

To a solution of 20 g of copolymer F in a mixture of 60 ml of acetone and 40 ml of ethylene glycol monomethyl ether a solution of 2.648 g of triethylamine in 25 ml of acetone and 25 ml of ethylene glycol monomethyl ether was added dropwise. The clear solution was stirred at 50° C. for 20 h.

The copolymer was separated by evaporating the solvent under reduced pressure conditions and dried under the same conditions after pulverization.

H. Quaternizing of copolymer F with triphenylphosphine (copolymer H).

The quaternizing reaction under G was repeated with the difference that the triethylamine was replaced by a same molar amount of triphenylphosphine.

The chloride anions in copolymers G and H can be exchanged by anions used according to the present invention in the same way as described hereinbefore.

Preparation III

A.II. Copolymerization of isobutyl methacrylate, stearyl methacrylate and dimethylaminoethylmethacrylate (copolymer A.II)

The preparation proceeded as described for copolymer A with the difference, however, that 60 g of isobutyl methacrylate 20 g of stearyl methacrylate and 20 g of dimethylaminoethyl methacrylate were used.

B.II. Quaternizing of copolymer A.II with methyl iodide.

The quaternizing proceeded analogously to the procedure used for copolymer B. 31.23% by weight of onium salt units were present in the copolymer having an iodine ($I^-$) content of 10.44 milliequivalent per gram (meq/g).

C.II. Introduction of $X^-$ in copolymer B.II $X^-$ =

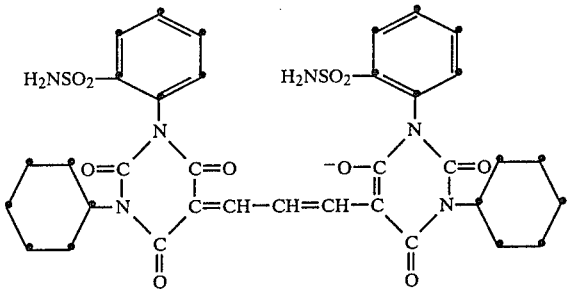

To a solution of 10 g of copolymer B.II having an iodine content of 10.44 meq/g in 100 ml of methanol were added dropwise whilst stirring 4 g of compound $X^-.Li^+$ in 300 ml of methanol.

After stirring the reaction mixture for 1 h at 20° C. the formed precipitate was separated and dried after washing with methanol. Yield: 12 g of copolymer C.II. Residual iodine content 0.302 meq/g. The replacement of $I^-$ by of $X^-$ proceeded at a ratio of 71.07%.

D.II. Introduction of $Y^-$ in copolymer B.II $Y^-$ =

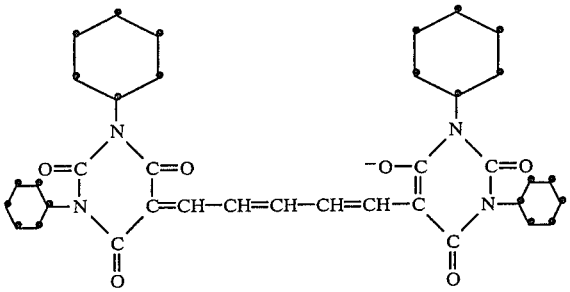

The introduction of $Y^-$ in copolymer B.II proceeded analogously to the introduction of $X^-$. The replacement of $I^-$ by $Y^-$ proceeded at 80.27% using $Y^-.Li^+$.

Preparation IV

B.III. Quaternizing of copolymer A with methyl iodide

The quaternizing proceeded analogously to the preparation of copolymer B.II but the iodine content was only 0.561 meq/g. The onium salt groups were present in a weight ratio of 16.76% with respect to the total weight of the copolymer.

C.III. Introduction of $X^-$ being

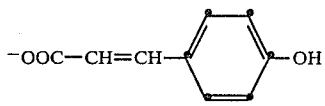

(p-hydroxy-cinnamic acid anion).

To a solution of 10 g of copolymer B.III in 100 ml of methanol were added dropwise at 20° C. whilst stirring 1.7 g of a solution in 100 ml of methanol of the lithium salt of p-hydroxy-cinnamic acid. During a period of 1 h stirring was continued at 20° C. The reaction mixture was poured into water whereby the copolymer C.III precipitated. It was separated by suction filtering and dried. Yield: 10 g. Residual iodine content: 0.561 meq/g. The replacement of $I^-$ by the p-hydroxycinnamic acid anion proceeded at a ratio of 54.72%.

When no special additional dispersing agent is present, onium salt copolymers are used which preferably contain 20 to 35 percent by weight of solvatizing recurring units derived from non-ionic hydrophobic solvatizing monomers, whereby said copolymer obtains a sufficient solvatation by the carrier liquid for forming a dispersion.

A typical onium salt copolymer used in the liquid toner developers of the invention contains from 10 to 88.5 percent by weight of non-ionic solvatizing monomer units, from 10 to 80 percent by weight of non-solvatizing monomer units and from 1.5 to 30 percent by weight of onium salt monomer units with a said anion. The percent by weight of said onium salt polymer with respect to the colouring matter (e.g. carbon black) of the liquid developer is preferably in the range of 2 to 50.

For a still better dispersing of the toner particles the homopolymer or copolymer containing onium salt recurring groups may be used in admixture with other polymers containing solvatable and optionally also non-solvatable monomer units but no onium salt monomer units.

The insulating liquid used as carrier liquid in the present liquid developer may be any kind of non-polar, fat-dissolving solvent. Said liquid is preferably a hydrocarbon solvent e.g. an aliphatic hydrocarbon such as hexane, cyclohexane, iso-octane, heptane or isododecane, a fluorocarbon or a silicone oil. Thus, the insulating liquid is e.g. isododecane or a commercial petroleum distillate, e.g. a mixture of aliphatic hydrocarbons having a boiling range preferably between 150° C. and 220° C. such as the ISOPARS G, H, K and L (trade marks) of Exxon and SHELLSOL T (trade mark) of the Shell Oil Company.

The colouring substance used in the toner particles may be any inorganic pigment (said term including carbon) or solid organic dyestuff pigment commonly employed in liquid electrostatic toner compositions. Thus, for example, use can be made of carbon black and analogous forms thereof e.g. lamp black, channel black and furnace black e.g. RUSS PRINTEX 140 GEPERLT (trade-name of DEGUSSA—Frankfurt/M, W. Germany).

Typical solid organic dyestuffs are so-called pigment dyes, which include phthalocyanine dyes, e.g. copper phthalocyanines, metal-free phthalocyanine, azo dyes and metal complexes of azo dyes.

The following dyes in pigment form are given for illustration purposes only: FANALROSA B Supra Pulver (trade-name of Badische Anilin-& Soda-Fabrik AG, Ludwigshafen, Western Germany), HELIOGENBLAU LG (trade-name of BASF for a metal-free phthalocyanine blue pigment), MONASTRAL BLUE (a copper phthalocyanine pigment, C.I. 74,160). HELIOGENBLAU B Pulver (trade-name of BASF), HELIOECHTBLAU HG (trade-name of Bayer AG, Leverkusen, Western Germany, for a copper phthalocyanine C.I. 74,160), BRILLIANT CARMINE 6B (C.I. 18,850) and VIOLET FANAL R (trade-name of BASF, C.I. 42,535).

Typical inorganic pigments include black iron(III) oxide and mixed copper(II) oxide/chromium(III) oxide/iron(III) oxide powder, milori blue, ultramarine cobalt blue and barium permanganate. Further are mentioned the pigments described in the French Pat. Nos. 1,394,061 filed Dec. 23, 1963 by Kodak Co., and 1,439,323 filed Apr. 24, 1965 by Harris Int. Corp.

Preferred carbon black pigments are marketed by DEGUSSA under the trade name PRINTEX. PRINTEX 140 and PRINTEX G are preferably used in the developer composition of the present invention. The characteristics of said carbon blacks are listed in the following Table 2.

TABLE 2

| | PRINTEX 140 | PRINTEX G |
|---|---|---|
| origin | channel black | furnace black |
| density | 1.8 g · cm$^{-3}$ | 1.8 g · cm$^{-3}$ |
| grain size before entering the developer | 29 nm | 51 nm |
| oil number (g of linseed oil adsorbed by 100 g of pigment) | 360 | 250 |
| specific surface (sq.m per g) | 96 | 31 |
| volatile material % by weight | 6 | 2 |
| pH | 5 | 8 |
| colour | brown-black | blue-black |

As colour corrector for the PRINTEX pigments preferably minor amounts of copper phthalocyanine are used, e.g. from 1 to 20 parts by weight with respect to the carbon black.

For a given charge density of the charge-carrying surface the maximum development density attainable with toner particles of a given size is determined by the charge/toner particle mass ratio, which is determined substantially by the amount and/or type of onium salt copolymer employed.

A liquid developer composition according to the present invention can be prepared by using dispersing and mixing techniques well known in the art. It is conventional to prepare by means of suitable mixers e.g. a 3-roll mill, ball mill, colloid mills, high speed stirrers, a concentrate of e.g. 5 to 80% by weight of the solid materials selected for the composition in the insulating carrier liquid and subsequently to add further insulating carrier liquid to provide the liquid toner composition ready for use in the electrostatic reproduction process. It is generally suitable for a ready-for-use electrophoretic liquid developer to incorporate the toner in an amount between 0.3 g and 20 g per liter, preferably between 2 g and 10 g per liter.

The copolymer(s) used in the present developer liquid can be applied as a pre-coating to the pigment particles prior to their introduction in the carrier liquid or can be introduced as a separate ingredient in the liquid and allowed to become adsorbed onto the pigment particles.

The electrophoretic development may be carried out using any known electrophoretic development technique or device. The field of the image to be developed may be influenced by the use of a development electrode. The use of a development electrode is of particular value in the development of continuous tone images. When no development electrode is used, the developed image may exhibit exaggerated density gradients, which may be of interest e.g. in certain medical X-ray images for diagnostic purposes.

The following examples illustrate the present invention.

EXAMPLE 1

1.5 g of copolymer prepared according to preparation I and containing stearyl methacrylate, isobutyl methacrylate and trimethylammonium ethyl methacrylate in a ratio by weight of 20, 70 and 10 having 2,4,6-tri(t-butyl)phenolate as counter-anion (copolymer E) was ground in a ball mill with 4 g of PRINTEX G (trade name) carbon black in 50 ml of isododecane for 15 h.

The obtained toner developer contained positively charged toner particles which was proven by the fact that the zeta potential ($\xi$) measured in a micro-electrophoresis cell built according to the description given by Van der Minne and Hermanie, J. Colloid Sci. 7, 600 (1952) had a positive sign.

By definition the zeta potential is the potential gradient across the diffuse double layer, which is the region between the rigid layer attached to the toner particle and the bulk of the solution (ref. C. P. Priesing—"A Theory of Coagulation useful for Design"—Ind. Eng. Chem., Vol. 54, No. 8, August 1962, pp. 40–41). The zeta potential ($\xi$) is related to Q, the charge of the particle, by the following formula:

$$\xi = \frac{Q}{\cdot r}\left(\frac{1}{1 + K \cdot r}\right)$$

wherein:

$\xi$ is the dielectric constant of the liquid, r is the radius of the particle, and lK is called the Debye-length; it has the dimensions of a length and is taken as a measure of the thickness of the double layer (ref. R. M. Schaffert—Electrophotography 2nd revised ed.—The Focal Press, London and New York (1975) 562–563).

The charge sign of the toner particles and their charge stability were determined by a test proceeding as follows:

"In an electrophoresis cell having two planar electrodes each with a surface of 20 $cm^2$ spaced at a distance of 0.15 cm is filled with the above toner developer of which 4 ml were diluted with 1 liter of isododecane. The electric current (I) flowing between the two electrodes at a voltage pulse of 500 V for 0.5 s is measured."

The current (I) is the result of a charge (Q) transport due to the inherent conductivity (without toner) of the liquid and the electrophoretic toner particle displacement towards one of the electrodes and the movement of its counter ions towards the other electrode. The toner-deposition (blackening) of the negative electrode (cathode) proves that the toner particles are positively charged. The $Q_T$ value is the current I in amperes integrated over the period (t) of 0.5 s and is a measure for the charging of the toner particles.

The charge stability of the toner particles was determined by measuring the $Q_{T1}$ value immediately after the developer preparation and $Q_{T2}$ 1 week thereafter upon redispersing optionally precipitated toner by stirring. A small difference in $Q_T$ value points to a high charge stability per toner particle i.e. a poor ion association and low particle agglomeration. $Q_{T1}$:$+5.10^{-8}$ C and $Q_{T2}$:$+6.5 \cdot 10^{-8}$ C.

The average diameter of the toner particles was 350 nm measured with the COULTER (trade mark) NANO-SIZER. The measuring principles used in this instrument are those of Brownian motion and autocorrelation spectroscopy of scattered laser light. The frequency of this Brownian motion is inversely related to particle size.

EXAMPLE 2

The same copolymer as described in Example 1, but now associated with tetraphenyl boride (copolymer D) as counter anion, was first dissolved in methyl ethyl ketone wherein the PRINTEX G (trade name) carbon black pigment was dispersed. After dispersion the solvent was evaporated leaving the copolyner coated onto the pigment particles. The copolymer-coated carbon black was then redispersed in isododecane in a ball mill. The obtained dispersed toner particles were positively charged, which was proved by zeta-potential measurement. The average toner particle diameter was about 400 nm measured as described in Example 1.

Immediately after preparation the $Q_{T1}$ value of the developer liquid was $+4.10^{-8}$ C and after 1 week standing and re-dispersing the $Q_{T2}$ value was $+3.10^{-8}$ C.

EXAMPLE 3

The same copolymer as described in Example 1, but now associated with tetradiphenyl boride anion prepared in an analogous way as copolymers D and E was used to produce positively charged toner particles by the procedure described in Example 2.

Zeta-potential measurement in the already described micro-electrophoresis cell proved that positively charged toner particles were present. The $Q_{T1}$ value of the developer liquid was $+6.5\times10^{-8}$ C and the $Q_{T2}$ value after 1 week standing was $+8\times10^{-8}$ C. The average toner particle diameter was about 400 nm measured as described in Example 1.

The obtained electrophoretic toner proved to be suited for the development of negatively charged areas on commercial zinc oxide photoconductor recording material which was negatively charged to $-500$ V by corona discharge before image-wise exposure.

EXAMPLE 4

The same copolymer as described in Example 1, but now associated with 7,7,8,8-tetracyano-p-quinodimethane radical anion prepared in an analogous way as copolymers D and E was used to produce positively charged toner particles by the procedure described in Example 2.

Zeta-potential measurement in the already described micro-electrophoresis cell proved that positively charged toner particles were present. The $Q_{T1}$ value of the developer liquid was $+3\times10^{-8}$ C and the $Q_{T2}$ value after 1 week standing was $+3.3\times10^{-8}$ C. The average toner particle diameter was about 400 nm measured as described in Example 1.

EXAMPLE 5

Comparative Example

For comparative test purposes a toner developer was prepared as described in Example 1 with the difference however, that the counter-anion was n-hexadecyl sulphonate (copolymer C). Zeta-potential measurement in the already described micro-electrophoresis cell proved that negatively charged toner particles were present. The $Q_T$ value being in agreement with the negative zeta-potential sign was $-6.5\cdot10^{-8}$ C.

EXAMPLE 6

Comparative Example

For comparative test purposes a copolymer was prepared as described in Example 1 but with the difference that the counter-anion was methyl sulphate. The copolymer being insoluble in isododecane was applied to the toner particles as described in Example 2.

The $Q_T$ value was $-6\times10^{-8}$ C.

EXAMPLE 7

Comparative Example

For comparative test purposes a toner developer was prepared as described in Example 1 with the difference however, that the counter-anion was a chloride ion.

The $Q_T$ value was $-3.5\times10^{-8}$ C.

EXAMPLE 8

The copolymer C.II prepared according to preparation III, C.II having as counter-anion:

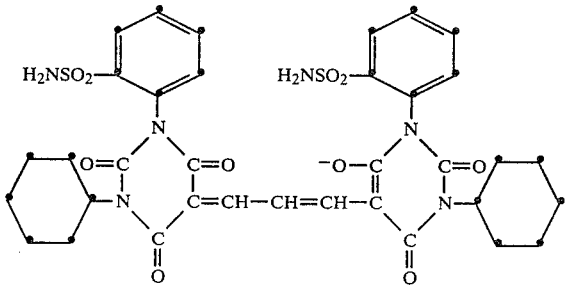

was used to produce positively charged toner particles by the procedure described in Example 2.

Immediately after preparation the $Q_{T1}$ value of the developer liquid was $+4\times10^{-8}$ C and after 1 week standing and re-dispersing the $Q_{T2}$ value was $+3.5\times10^{-8}$ C.

The obtained electrophoretic toner proved to be suited for the development of negatively charged areas on commercial zinc oxide photoconductor recording material which was negatively charged to $-500$ V by corona discharge before image-wise exposure.

EXAMPLE 9

The copolymer D.II as described in preparation III, D.II having as counter anion:

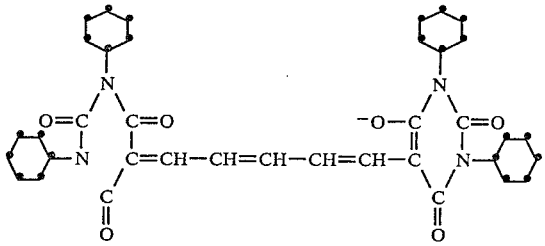

was used to produce positively charged toner particles by the procedure described in Example 2.

Zeta-potential measurement in the already described micro-electrophoresis cell proved that positively charged toner particles were present. The $Q_{T1}$ value of the developer liquid was $+3\times10^{-8}$ C and the $Q_{T2}$ value after 1 week standing was $+3\times10^{-8}$ C. The average toner particle diameter was about 400 nm measured as described in Example 1.

The obtained electrophoretic toner proved to be suited for the development of negatively charged areas on commercial zinc oxide photoconductor recording material which was negatively charged to $-500$ V by corona discharge before image-wise exposure.

EXAMPLE 10

The copolymer C.III, preparated as described in preparation IV, C.III with p-hydroxy-cinnamic acid anion was used to produce positively charged toner particles by the procedure described in Example 2.

Zeta-potential measurement in the already described micro-electrophoresis cell proved that positively charged toner particles were present. The $Q_{T1}$ value of the developer liquid was $+3\times10^{-8}$ C and the $Q_{T2}$ value after 1 week standing was $+4\times10^{-8}$ C. The average toner particle diameter was about 400 mm measured as described in Example 1.

The obtained electrophoretic toner proved to be suited for the development of negatively charged areas on commercial zinc oxide photoconductor recording material which was negatively charged to $-500$ V by corona discharge before image-wise exposure.

We claim:

1. A liquid developer composition that is suitable for rendering visible electrostatically charged areas which composition contains in an electrically insulating non-polar carrier liquid having a volume resistivity of at least $10^9$ ohm.cm and a dielectric constant less than 3, dispersed colouring matter acting as toner particles and at least one onium salt polymer including recurring units incorporating an onium group together with an anion, characterized in that the said anion has at least one of the characteristics (1) to (4) as follows:

(1) contains a negatively charged atom or group of atoms which is sterically embraced by at least two non-ionic substituents containing at least 4 C atoms;

(2) contains a negatively charged atom which is sterically embraced by at least 4 atoms selected from the group consisting of oxygen and halogen;

(3) contains a negatively charged atom or group of atoms the negative charge of which is delocalized over other atoms linked to said atom or group of atoms;

(4) is a radical anion, whereby the said polymer is adsorbed with a net positive charge on the toner particles.

2. Liquid developer composition according to claim 1, characterized in that the anion is a polyatomic anion the negative charge of which is localized on an atom or group of atoms which is sterically embraced by at least two non-ionic hydrocarbon substituents containing at least 4 carbon atoms.

3. Liquid developer composition according to claim 2, characterized in that the anion is a sterically hindered phenolate or aromatic carboxylate having as substituents $C_4$–$C_{20}$ alkyl, aralkyl, cycloalkyl or aryl groups to embrace the —O⁻ or —COO⁻ group; or is a tetrahydrocarbon substituted boride anion according to the following general formula:

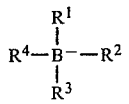

wherein:

each of $R^1$, $R^2$, $R^3$ and $R^4$ (same or different) represents a $C_4$–$C_{20}$ alkyl, alkenyl, cycloalkyl, aralkyl or aryl group.

4. Liquid developer composition according to claim 1, characterized in that the anion is a polyatomic anion which contains a negatively charged central atom embraced by at least 4 oxygen atoms.

5. Liquid developer composition according to claim 1, characterized in that the anion is a polyatomic anion containing a negatively charged central borine, arsenic, aluminium, silicon, phosphorus, tin, antimony, tantalum or bismuth atom surrounded by at least 4 fluorine atoms.

6. Liquid developer composition according to claim 1, characterized in that the anion is a polyatomic anion wherein the negative charge is delocalized over an aromatic conjugated system of alternating single and double bonds by the presence thereon of one or more electron-withdrawing substituents.

7. Liquid developer composition according to claim 6, characterized in that said anion corresponds to the following general formula:

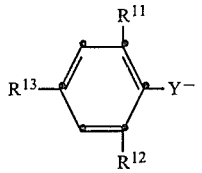

wherein:

Y⁻ represents a —O⁻ or —S⁻ group, and $R^{11}$, $R^{12}$ and $R^{13}$ (same or different) is an —$NO_2$, halogen, —CN, —$CF_3$ or —CHO group.

8. Liquid developer composition according to claim 1, characterized in that the anion is the anion of an anionic dye having in the anion a delocalized negative charge.

9. Liquid developer composition according to claim 8, characterized in that the anionic dye is a phthalocyanine dye, an oxonol dye or a phenolphthaleine dye.

10. Liquid developer composition according to claim 1, characterized in that the recurring units are derived from one of the following monomers having general formulae (A), (B), (C), (D), (E), (F) or (G):

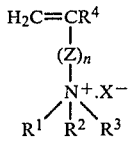

(A)

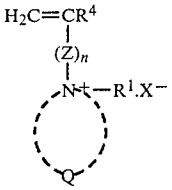

(B)

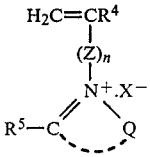

(C)

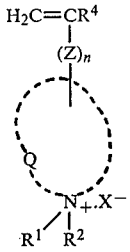

(D)

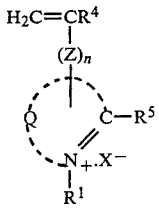

(E)

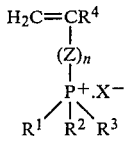

(F)

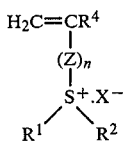

(G)

wherein:

each of $R^1$, $R^2$ and $R^3$ (same or different) represents hydrogen, an alkyl, a cycloalkyl, an aralkyl or an aryl group, each of $R^4$ and $R^5$ is hydrogen or lower ($C_1$–$C_4$) alkyl, Q represents the atoms necessary to complete a 5- or 6-membered heterocyclic ring, Z is selected from the group consisting of —$R^6$—, $$-\overset{O}{\overset{\|}{C}}-OR^6-,\ -\overset{O}{\overset{\|}{C}}-NH-R^6-,$$

$$-O-\overset{O}{\overset{\|}{C}}-R^6-,\ \text{and}\ -CH_2-O-\overset{O}{\overset{\|}{C}}-R^6$$

wherein:

$R^6$ is alkylene, arylene or arylenealkylene having from 1 to 20 carbon atoms, n is 0 or 1, and $X^-$ is an anion as set forth in claim 1.

11. Liquid developer composition according to claim 1, characterized in that the said onium polymer is a copolymer of an onium salt and a solvatable monomer whereby the copolymer becomes solvatable by the carrier liquid.

12. Liquid developer according to claim 11, characterized in that said solvatable monomer is a non-ionic hydrophobic monomer selected from the group comprising:

alkylstyrenes having from 3 to 10 carbon atoms in the alkyl group, alkoxystyrenes having from 3 to 10 carbon atoms in the alkyl group, alkyl acrylates and alkyl methacrylates having from 8 to 22 carbon atoms in the alkyl group vinyl alkyl ethers having from 8 to 22 carbon atoms in the alkyl group, vinyl esters of alkanoic acids having from 6 to 22 carbon atoms in the alkyl group.

13. Liquid developer composition according to claim 11, characterized in that the copolymer also comprises recurring units of non-ionic practically non-solvatable monomers selected from the group comprising:

(a) $\alpha,\beta$-ethylenically unsaturated carboxylic acid alkyl esters in which the alkyl group is a $C_1$–$C_4$ group, (b) styrene, methylstyrene, methoxystyrene and halogenated styrene;

(c) vinyl alkyl ethers having from 1 to 4 carbon atoms in the alkyl group, and (d) vinyl esters of alkanoic acids having from about 1 to about 4 carbon atoms in the alkyl groups, and mixtures thereof.

* * * * *